US007179102B2

(12) United States Patent
Yamashita

(10) Patent No.: US 7,179,102 B2
(45) Date of Patent: Feb. 20, 2007

(54) CONNECTOR, A CONNECTOR ASSEMBLY AND AN ASSEMBLY METHOD

(75) Inventor: Kazunori Yamashita, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 61 days.

(21) Appl. No.: 10/959,506

(22) Filed: Oct. 6, 2004

(65) Prior Publication Data

US 2005/0048820 A1 Mar. 3, 2005

(30) Foreign Application Priority Data

Oct. 8, 2003 (JP) ..... 2003-349857

(51) Int. Cl.
*H01R 13/62* (2006.01)

(52) U.S. Cl. ..... 439/157

(58) Field of Classification Search ..... 439/157, 439/347, 701

See application file for complete search history.

(56) References Cited

U.S. PATENT DOCUMENTS 5,681,184 A * 10/1997 Pamart et al. ..... 439/595
5,735,713 A 4/1998 Sugiura
6,244,880 B1 6/2001 Fukase et al.

* cited by examiner

*Primary Examiner*—Neil Abrams
(74) *Attorney, Agent, or Firm*—Gerald E. Hespos; Anthony J. Casella

(57) ABSTRACT

A connector (10) has auxiliary housings (12) that can be mounted in a housing main body (11) by a cam action generated by a slider (20) having sliding plates (22). Locks (15) lock the properly mounted auxiliary housings (12) in the housing main body (11). The locks (15) are deformed into movement paths for the sliding plates (22) when auxiliary housings (12) are mounted improperly, thereby preventing movement of the slider (20) to a connecting position. However, the locks (15) are retracted from the movement paths for the sliding plates (22) when the auxiliary housings (12) are mounted properly so that the slider (20) can move to the connecting position.

12 Claims, 11 Drawing Sheets

CONNECTOR, A CONNECTOR ASSEMBLY AND AN ASSEMBLY METHOD

BACKGROUND OF THE INVENTION

1. Field of the Invention

The invention relates to a connector connectable to a connector assembly by operating a movable member.

2. Description of the Related Art

U.S. Pat. No. 6,244,880 discloses a connector assembly with first and second connectors that are connectable with one another. A slider is provided in the first connector and is movable along a direction intersecting connecting and separating directions of the connectors. A cam groove is formed in the slider and engages a cam follower of the second connector. The first and second connectors are connected or separated by a cam action between the cam groove and the cam follower.

U.S. Pat. No. 5,735,713 discloses a connector with no slider, but with auxiliary housings mounted into one housing main body. This divided type of connector can be applied to slider-type connectors if necessary. In this regard, auxiliary housings can be mounted in a housing main body that has a slider mounted therein. Resiliently deformable locks may be provided in the housing main body for holding the auxiliary housings in the housing main body.

The terminals of the auxiliary housing may not be connected properly with the terminals of the second connector if the slider is operated while an auxiliary housing is mounted improperly.

The invention was developed in view of the above problem, and an object thereof is to prevent a movable member from being operated in a connecting direction while an auxiliary housings is inserted insufficiently.

SUMMARY OF THE INVENTION

The invention relates to a connector with auxiliary housings mounted in a housing main body. A movable member is mounted movably on the housing main body and can be moved from a standby position to a connecting position to generate a cam action that connects the connector with a mating connector. A preventing means is provided for blocking a movement path of the movable member and thus preventing movement of the movable member from the standby position to the connecting position when the auxiliary housings are mounted improperly or insufficiently. However, the preventing means is retracted from the movement path for the movable member and permits movement of the movable member from the standby position to the connecting position when the auxiliary housings are mounted properly.

Locks preferably are deformed in the process of mounting the auxiliary housings into the housing main body and resiliently restore to lock the auxiliary housings when the auxiliary housings are mounted in the housing main body. The locks may also serve as the preventing means. Thus, the construction and shape can be simplified as compared to a case where a preventing means has an exclusive function.

The movable member preferably is held substantially in contact with the locks to prevent the locks from deforming when the movable member is moved to the connecting position. Thus, the locks cannot deform and the auxiliary housings are locked securely.

The preventing means preferably comprises a skirt on the auxiliary housing for contacting and resiliently deforming the lock.

The movable member may comprise a slider that is movable along a moving direction arranged at an angle to an inserting direction of the auxiliary housings into the housing main body.

The movable member may comprise a lever that rotates on the connector for displaying a cam action in cooperation with the mating connector.

Locking means may be provided for temporarily locking the movable member at the standby position and/or the connecting position.

The invention also relates to a connector assembly comprising the above-described connector and a mating connector. Connection of the connectors is assisted by the cam action displayed by the movable member in cooperation with the mating connector.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
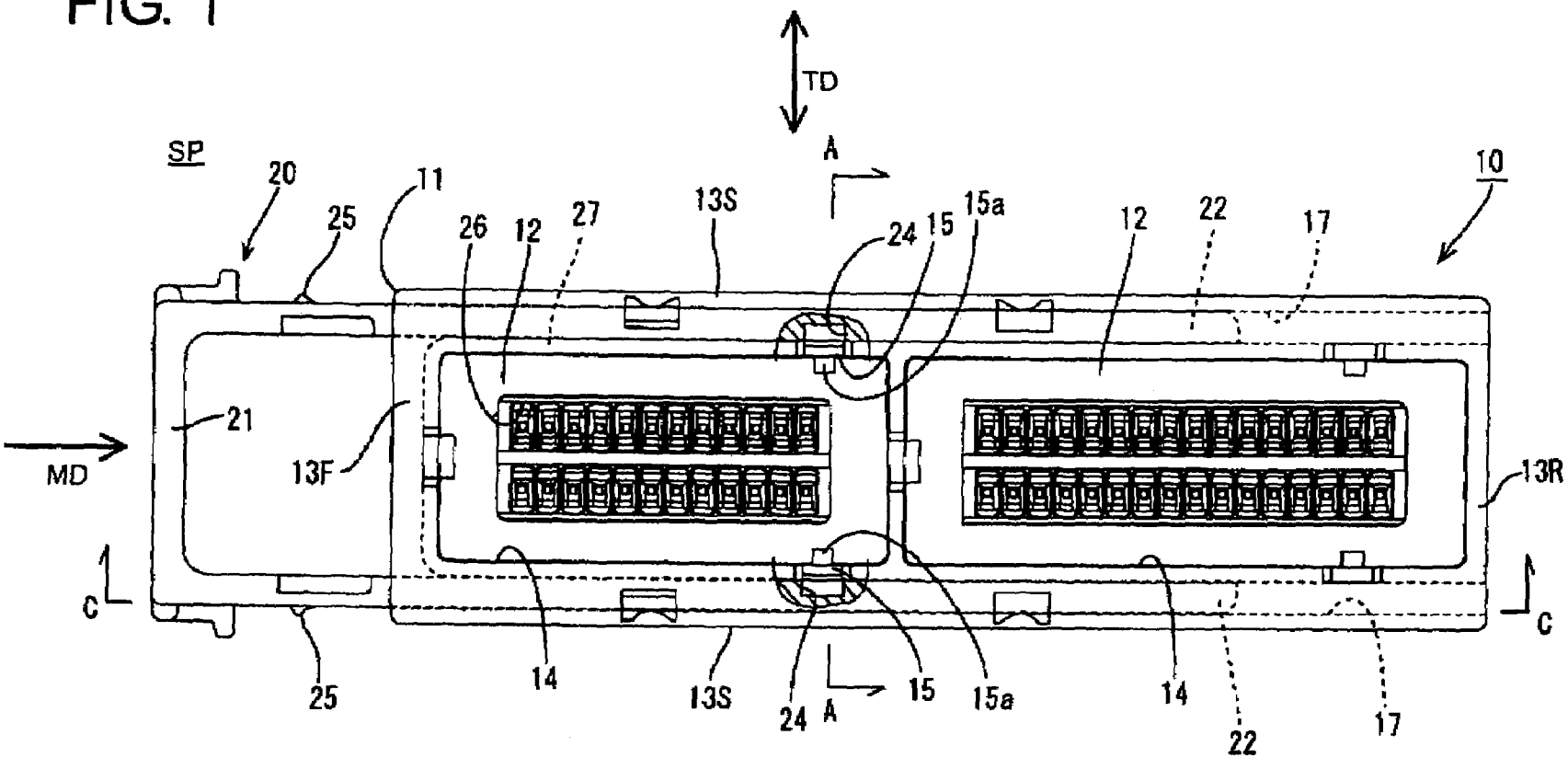
FIG. 1 is a plan view partly in section of a first connector according to one embodiment, showing a state where a slider is at a standby position.

A connector assembly according to the invention includes a first connector 10, a slider 20 and a second connector 30 as illustrated in FIGS. 1 to 11. The left side in FIG. 1 is referred to as the front side in the following description.

The first connector 10 has a synthetic resin housing main body 11 and front and rear auxiliary housings 12 are mounted in an inserting direction ID into the housing main body 11. The housing main body 11 is comprised of a front wall 13F, a rear wall 13R, and left and right side walls 13S. Front and rear cavities 14 are formed in the housing main body 11 and are exposed to the outside of the housing main body 11 through openings formed in both upper and bottom surfaces of the housing main body 11. More particularly, the respective cavities 14 penetrate the housing main body 11 substantially vertically substantially along the insertion direction ID of the auxiliary housing 12 into the housing main body 11.

Two cantilevered locks 15 extend substantially up along the inner wall surfaces at the rear ends of the opposite left and right inner walls of each cavity 14. Each lock 15 is resiliently deformable in a transverse direction TD substantially normal to the inserting direction ID. An inward-projecting locking projection 15*a* is formed at the leading end of each lock 15. A step is formed substantially continuously over the entire inner periphery of the front, rear, left and right walls of each cavity 14, and the upper surface of the step defines a receiving surface 16.

The housing main body 11 has two guide holes 17 that penetrate the left and right side walls 13S substantially along forward and backward directions. The guide holes 17 are substantially slit-shaped and have a long dimension aligned along the inserting direction ID. Outer surfaces of the locks 15 face the guide holes 17 so that the locks 15 can deform outward and into the guide holes 17. Each side wall 13S of the housing main body 11 has front and rear guiding holes 18 penetrating from the bottom of the corresponding guide hole 17 to the bottom surface of the housing main body 11.

The slider 20 has a coupling plate 21 aligned substantially parallel with the front wall 13F of the housing main body 11. Sliding plates 22 extend substantially back along the moving direction MD from the opposite left and right edges of the coupling plate 21 substantially parallel with the left and right side walls 13S of the housing main body 11. The slider 20 is supported on the housing main body 11 by fitting the sliding plates 22 into the guide holes 17. Thus, the slider 20 is movable forward and backward along a moving direction MD between a standby first position SP (see FIGS. 1, 3, 6, 8) and a connecting position CP (see FIGS. 2, 7) that is more backward than the standby position SP. The engagement of the sliding plates 22 in the guide holes 17 permits the slider 20 to move along the moving direction MD without shaking along vertical and transverse directions. Each sliding plate 22 has front and rear cam grooves 23 that are oblique to both the moving direction MD of the slider 20 and the connecting and separating directions CSD of the connectors 10, 30 (i.e. the inserting direction ID). Bottom ends of the cam grooves 23 open at the bottom edge of the sliding plate 22.

A vertically long recess 24 is formed on the inner surface of each sliding plate 22 at an intermediate position with respect to the moving direction MD. The recesses 24 correspond to the locks 15 along the inserting direction ID, and the width of the recess 24 along the moving direction MD is slightly larger than the dimension of the lock 15 along the moving direction MD. The depth of the recesses 24 along the transverse direction TD substantially normal to both the inserting direction ID and the moving direction MD is equal to or slightly larger than a projecting distance of the locking projections 15*a* from the inner surfaces of the locks 15. Front and rear inner surfaces of the recesses 24 are substantially flat and are aligned at substantially right angles to the moving direction MD of the sliding plates 22.

Resilient locking pieces 25 are formed on the sliding plates 22 and engage portions (not shown) on the inner surfaces of the guide holes 17 to hold the slider 20 at the standby position SP or the connecting position CP without shaking. However, an external force of a specified intensity or higher exerted on the slider 20 causes the resilient locking pieces 25 to disengage from the engaging portions so that the slider 20 can move. With the slider 20 held at the standby position SP, the recesses 24 of the sliding plates 22 substantially correspond to the front locks 15, the rear ends of the sliding plates 22 are before the rear locks 15, and the bottom end entrances of the cam grooves 23 correspond to the guiding holes 18 of the housing main body 11. With the slider 20 held at the connecting position CP, the inner surfaces of the sliding plates 22 contact the outer surfaces of both front and rear locking positions or are opposed thereto with almost no clearance, thereby preventing the locks 15 from being deformed resiliently out towards the sliding plates 22.

Figure 5:
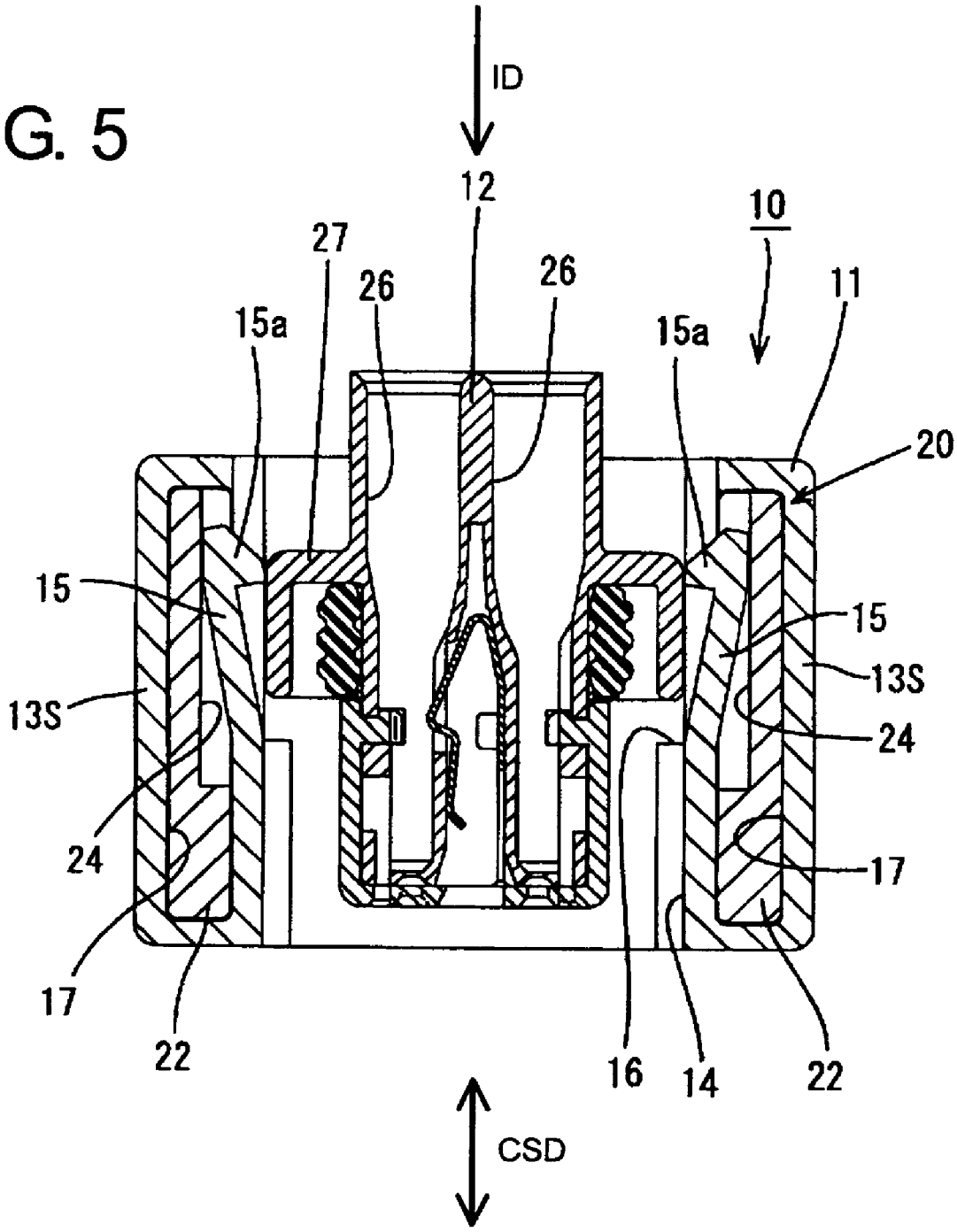
FIG. 5 is a section along 5—5 of FIG. 3.
Figure 6:
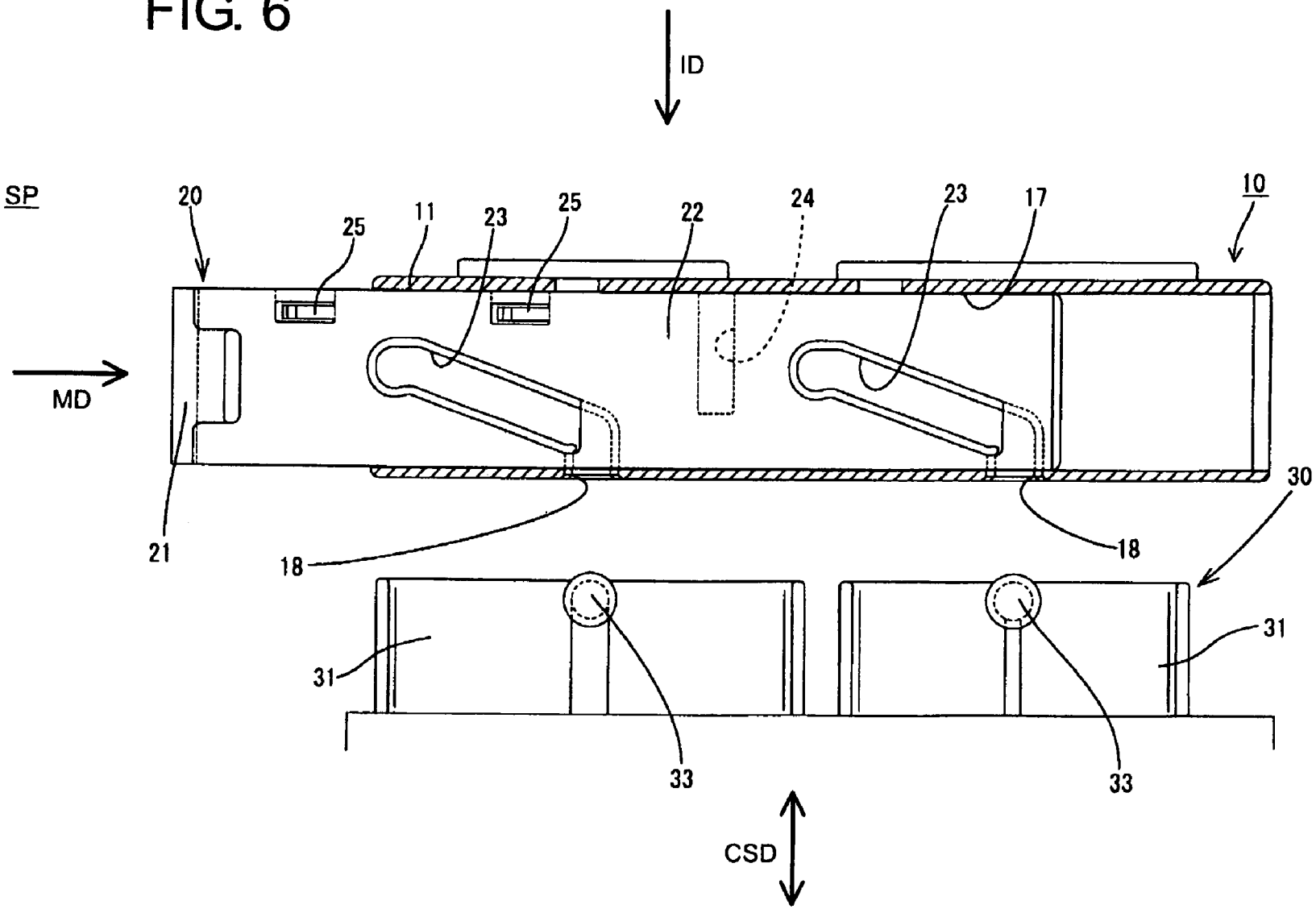
FIG. 6 is a section along 6—6 of FIG. 1.
Figure 7:
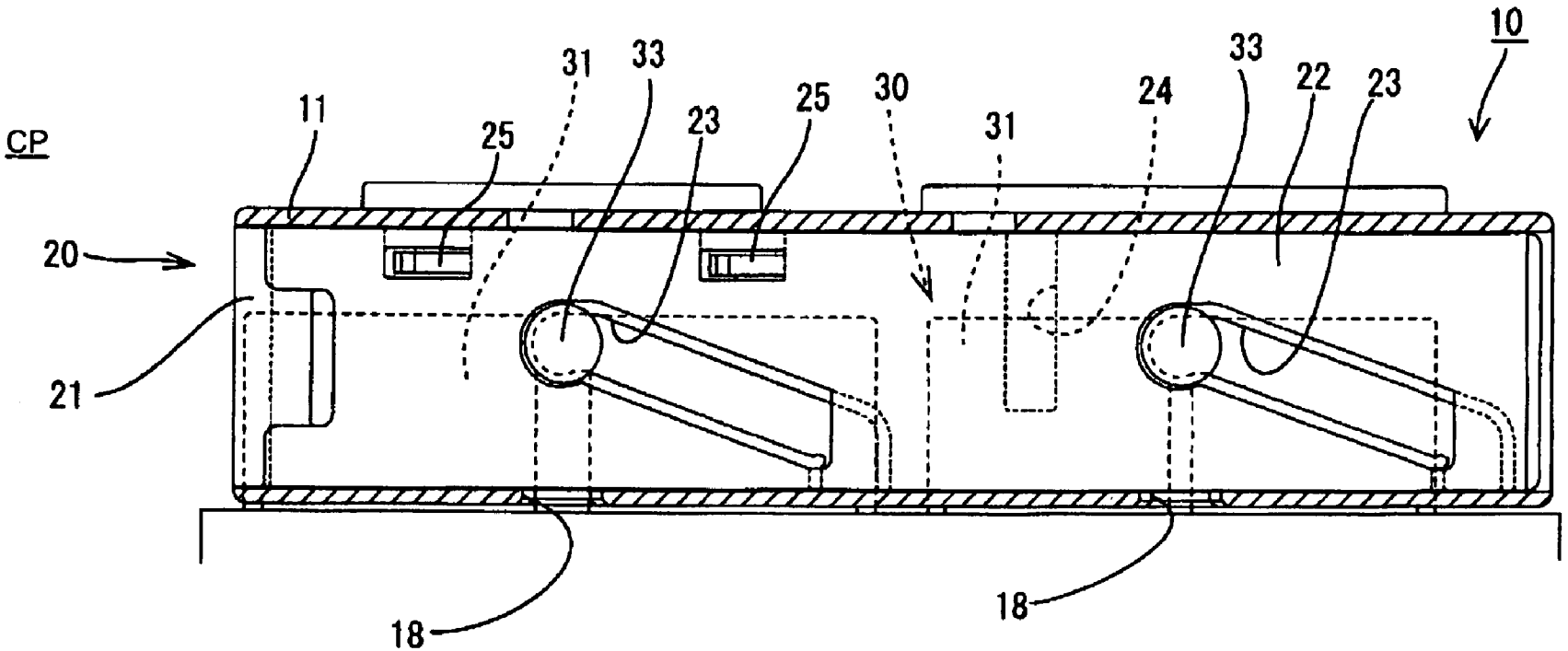
FIG. 7 is a section along 7—7 of FIG. 3.
Figure 8:
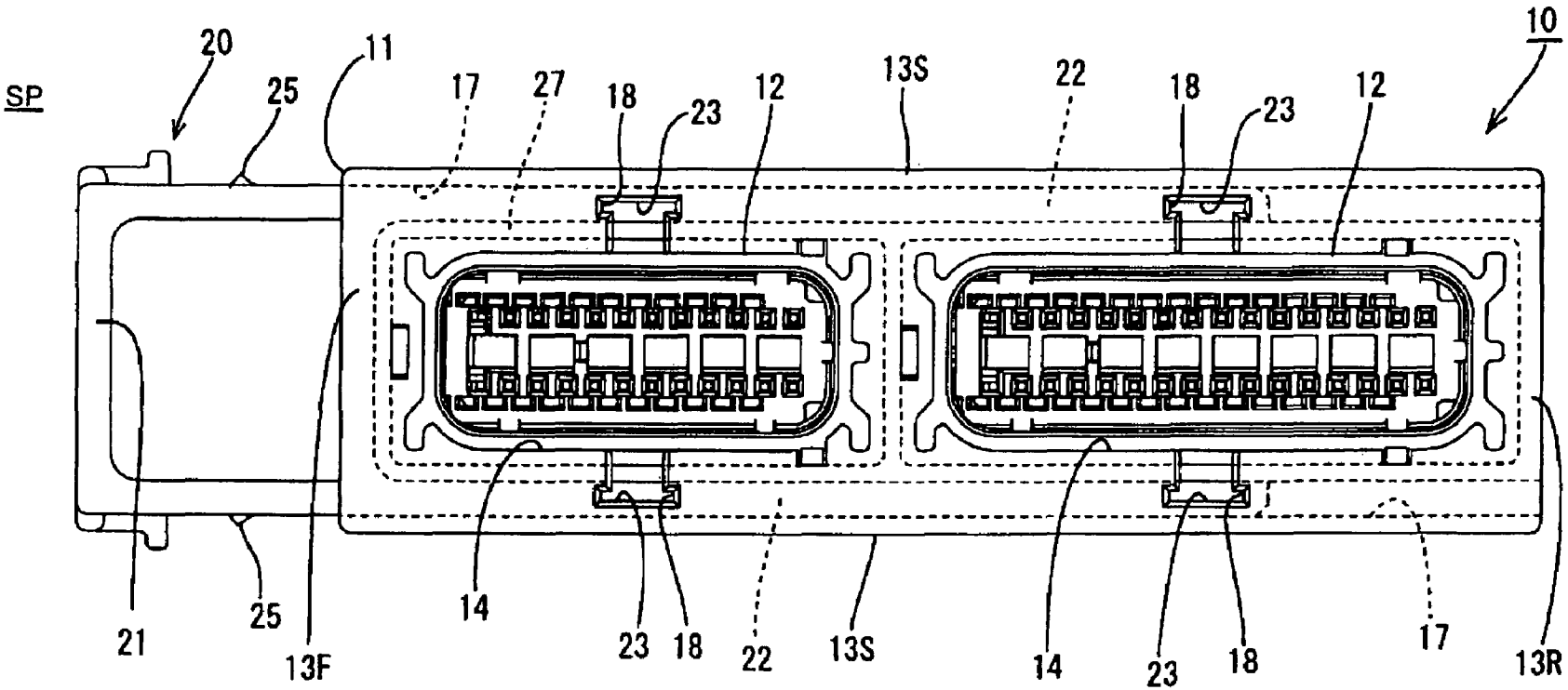
FIG. 8 is a bottom view of the first connector showing a state where the slider is at the standby position.
Figure 9:
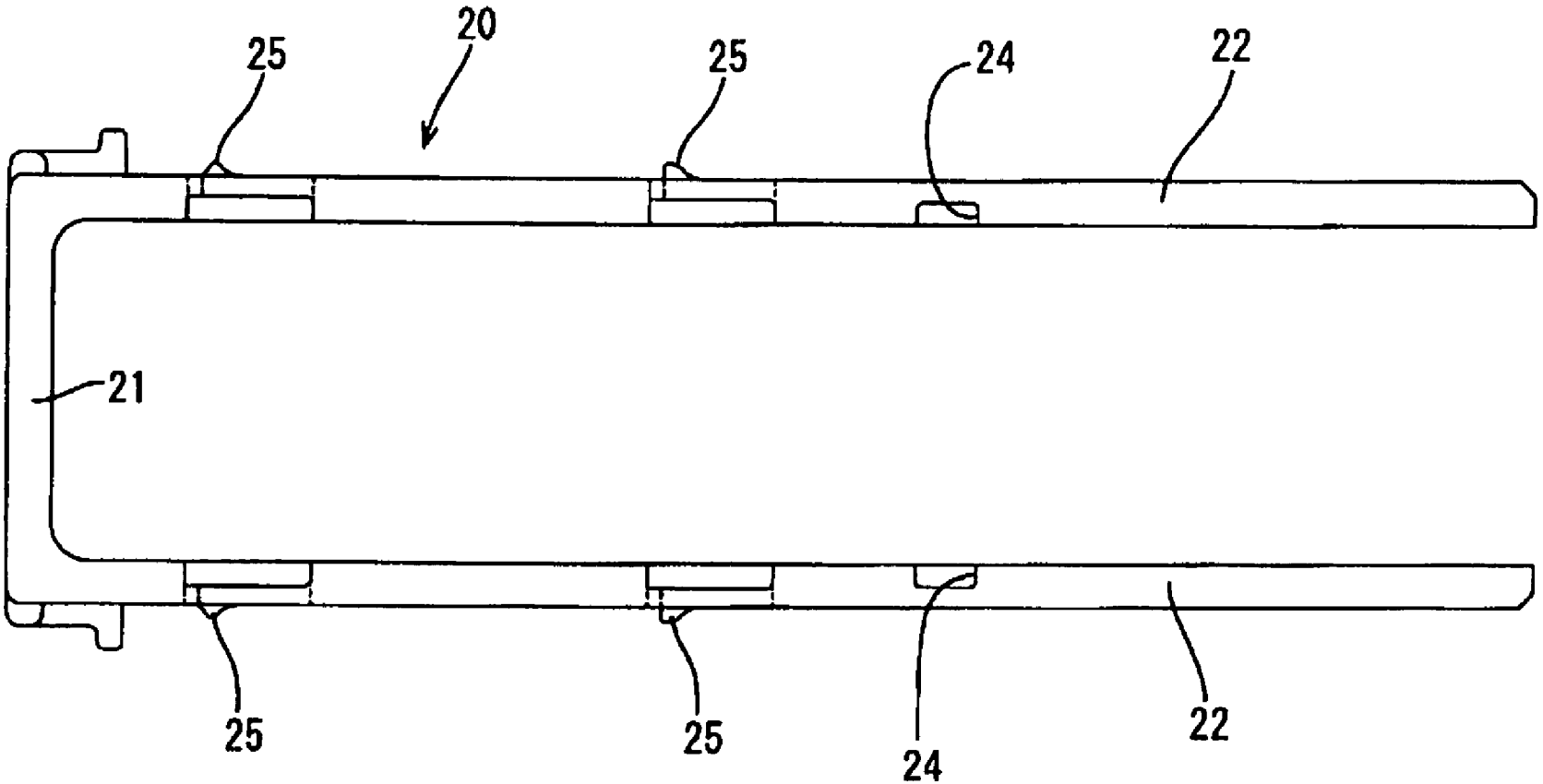
FIG. 9 is a plan view of the slider.
Figure 10:
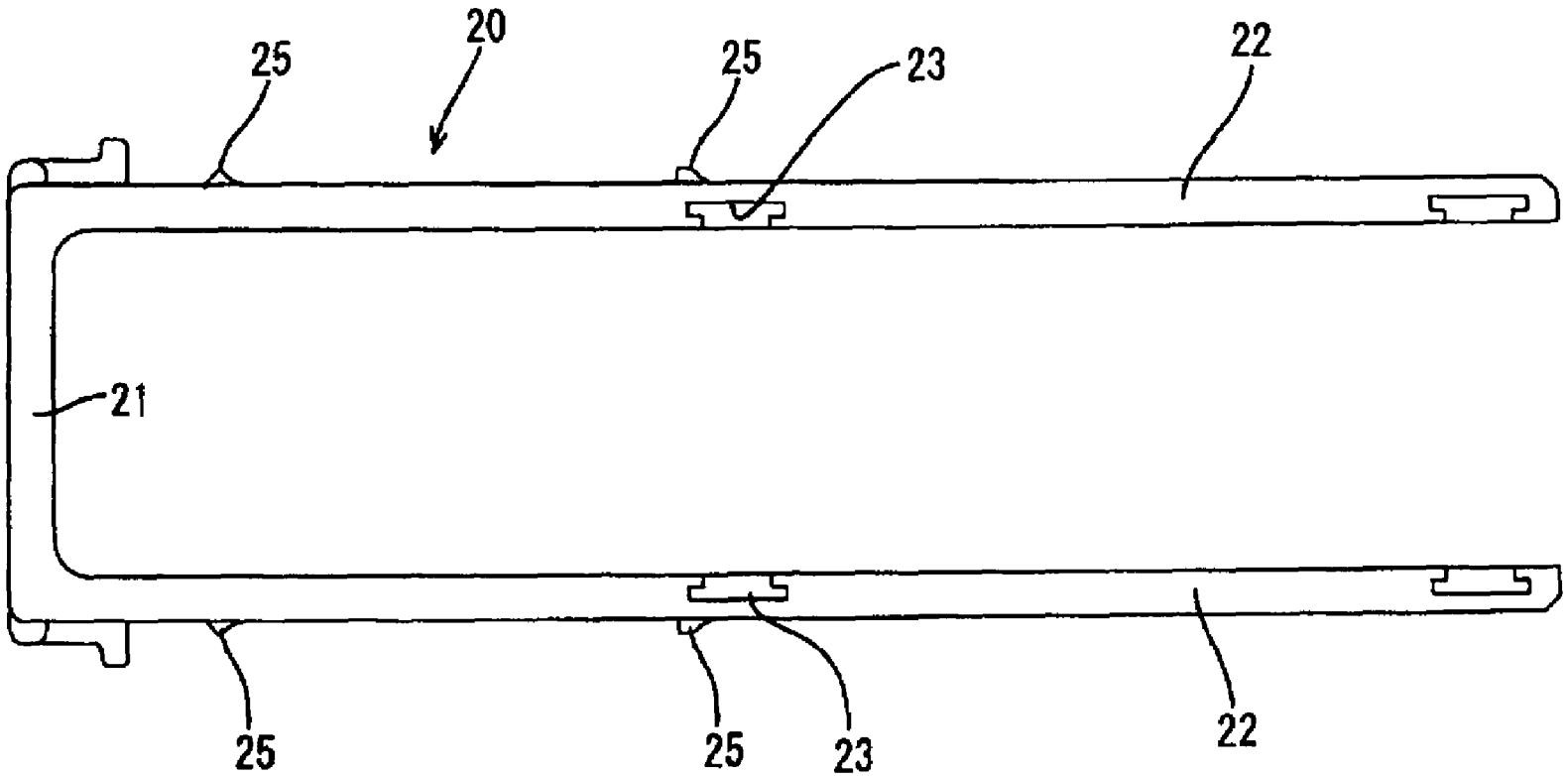
FIG. 10 is a bottom view of the slider.
Figure 11:
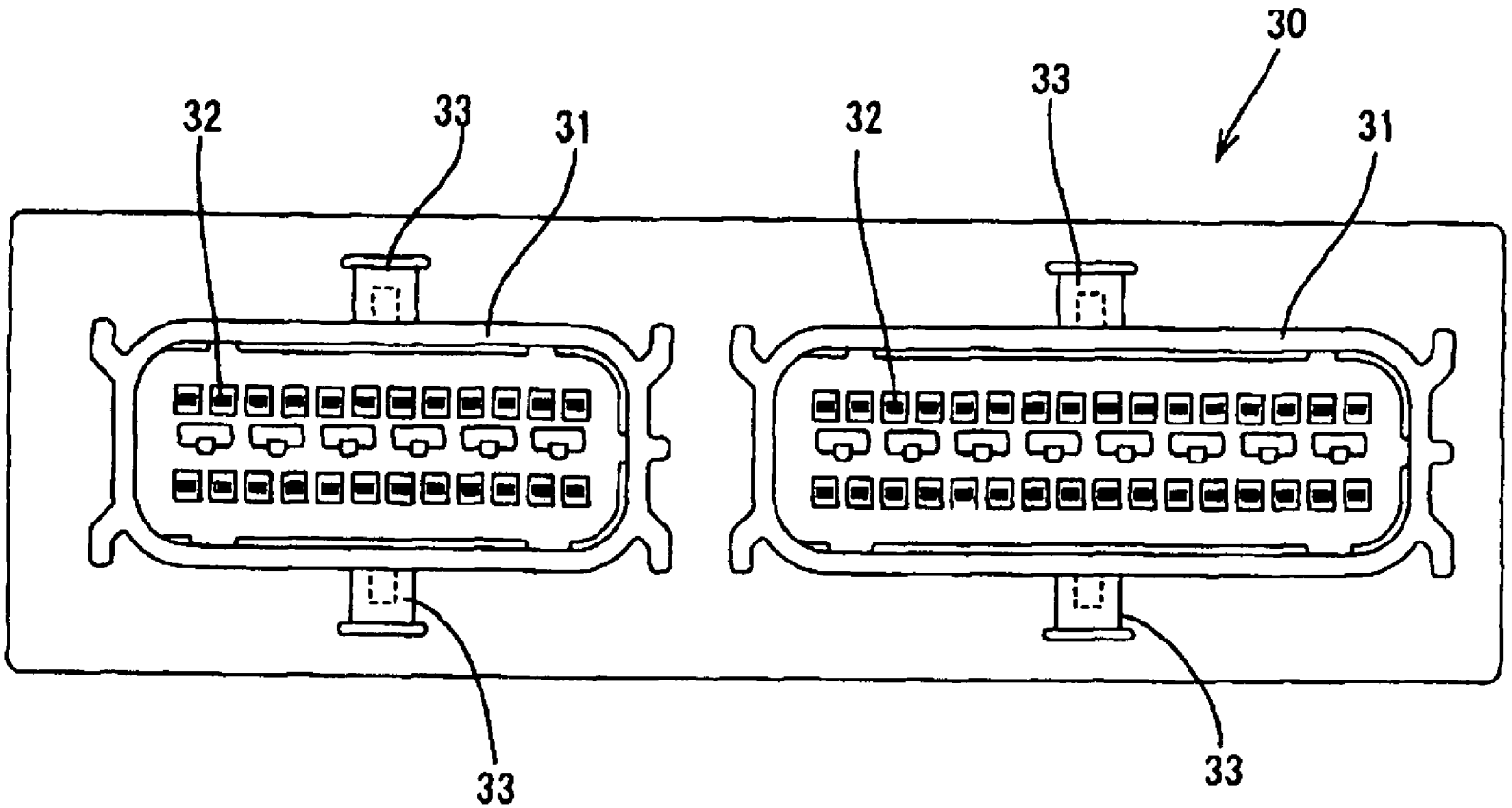
FIG. 11 is a plan view of a second connector.

Each auxiliary housing 12 has a plurality of terminal chambers 26, and unillustrated terminal fittings are accommodated into the respective terminal chambers 26. A skirt 27 is formed over substantially the entire circumference on the outer surfaces of each auxiliary housing 12 and can contact the receiving surface 16 of the housing main body 11 from above and along the inserting direction ID. The skirt 27 defines a ring space for accommodating a seal S for sealing a connection with the second connector 30. Each auxiliary housing 12 is fit into the corresponding cavity 14 of the housing main body 11 in the inserting direction ID and has shaking movements along the moving direction MD and the transverse direction TD prevented by contact of the outer surface of the skirt 27 with the inner surface of the cavity 14. Interference of the skirt 27 causes the locks 15 to deform resiliently out in the transverse direction TD, as shown in FIG. 5. However, the bottom end of the skirt 27 contacts the receiving surface 16 of the housing main body 11 from above and in the inserting direction ID when the auxiliary housing 12 is fit properly. The locking projections 15*a* of the locks 15 then resiliently return inward to engage the upper surface of the skirt 27. In this way, the auxiliary housing 12 is prevented from making up and down shaking movements along the inserting direction ID relative to the housing main body 11.

The second connector 30 is disposed, for example, on the upper surface of an electrical or electronic device, such as a printed circuit board, junction box, etc. and includes substantially rectangular front and rear tubes 31 projecting up substantially along connecting and separating directions CSD, which is substantially parallel to the inserting direction ID for fitting inside the skirts 27. Tab terminals 32 are accommodated in the respective tubes 31 and are arranged substantially along the connecting and separating directions CSD for connection with the terminal fittings (not shown) in the auxiliary housings 12. Round cam followers 33 project from the right and left outer side surfaces of the respective tubes 31 and have axes that extend in the transverse direction TD.

The two connectors 10, 30 can be connected along the connecting and separating directions CSD by putting the first connector 10 on the second connector 30 with the slider 20 at the standby position SP. Thus, the skirts 27 of the auxiliary housings 12 fit lightly on the tubes 31 of the second connector 30. The cam followers 33 then enter the entrances of the cam grooves 23 through the guiding holes 18. The slider 20 then is pushed in the moving direction MD. As a result, the first connector 10 is pulled along the connecting and separating directions CSD towards the second connector 30 by cam action between the cam grooves 23 and the cam followers 33. The connectors 10, 30 are connected properly when the slider 20 reaches the connecting position CP.

Figure 4:
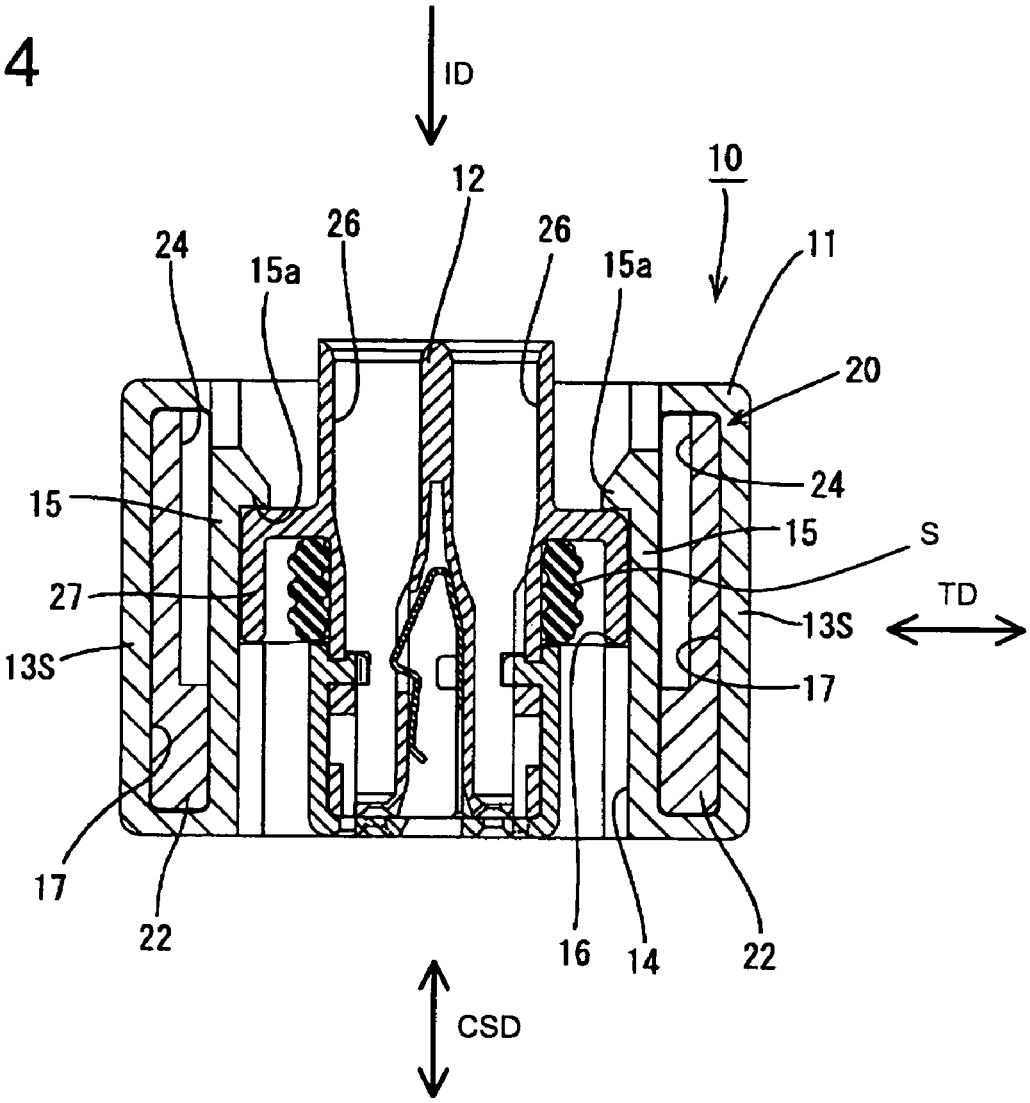
FIG. 4 is a section along 4—4 of FIG. 1.

The locks 15 restore resiliently, as shown in FIG. 4, to positions inside the guide holes 17 when the auxiliary housings 12 are mounted properly in the housing main body 11. Thus, the locks 15 are retracted inward from the movement paths for the sliding plates 22 of the slider 20. Accordingly, the sliding plates 22 can move smoothly in the guide holes 17 without interfering with the locks 15, and the slider 20 can be moved in the moving direction MD from the standby position SP to the connecting position CP.

On the other hand, the locks 15 remain deformed by the skirts 27 and are in the recesses 24 of the sliding plates 22, as shown in FIG. 5, if the auxiliary housings 12 are not mounted properly in the housing main body 11. Thus, the locks 15 are located in the movement paths for the sliding plates 22, and the front inner surfaces of the recesses 24 will contact the locks 15 if an attempt is made to move the slider 20 from the standby position SP to the connecting position CP. Movements of the sliding plates 22 to the connecting position CP are prevented by this contact.

As described above, the locks 15 interfere with the slider 20 if the auxiliary housings 12 are not mounted properly. Thus, a movement of the slider 20 from the standby position SP to the connecting position CP is hindered, and the two connectors 10, 30 cannot be connected. Further, this hindered movement of the slider 20 enables the improperly mounted state of the auxiliary housings 12 to be detected.

The locks 15 also are preventing means for preventing movement of the slider 20 to the connecting position CP when the auxiliary housings 12 are mounted improperly. Thus, the construction is simplified as compared to a case where a preventing means is separate from the locks 15.

Figure 2:
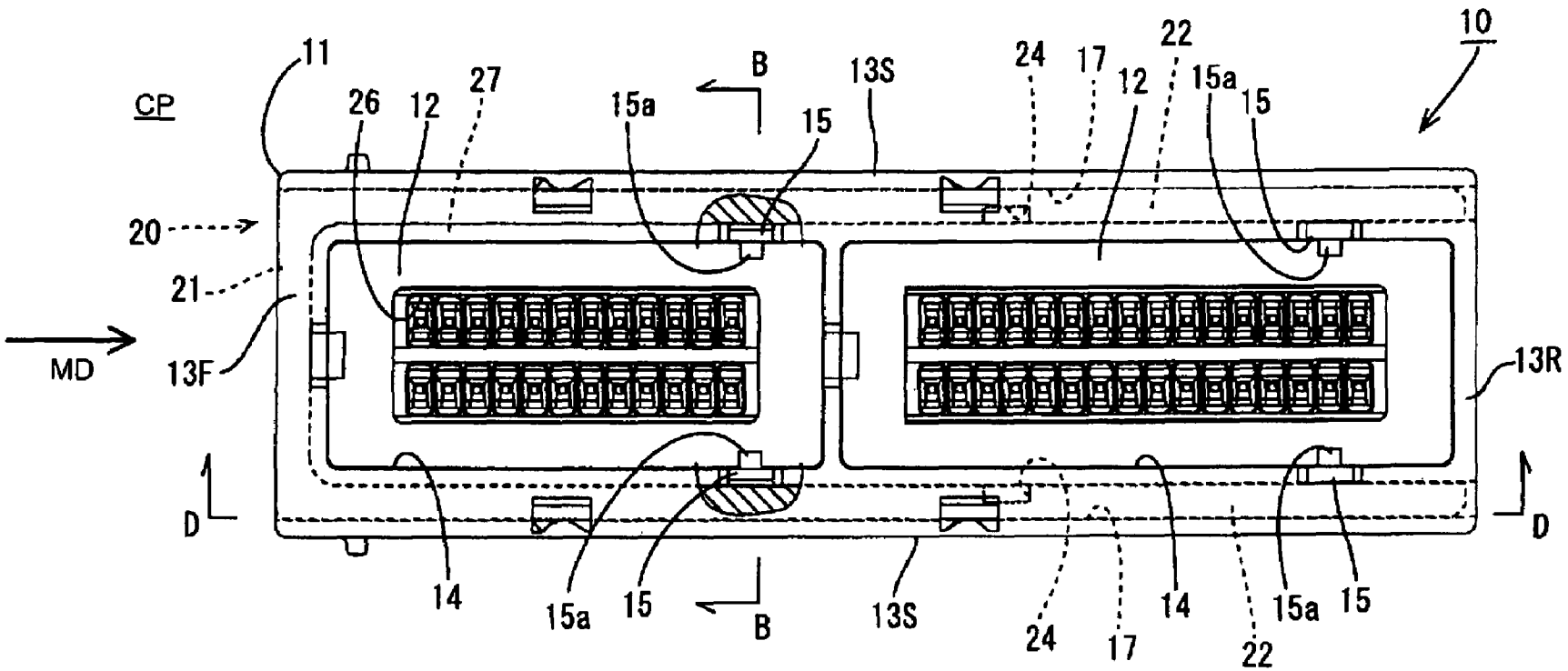
FIG. 2 is a plan view partly in section of the first connector showing a state where the slider is at a connecting position.
Figure 3:
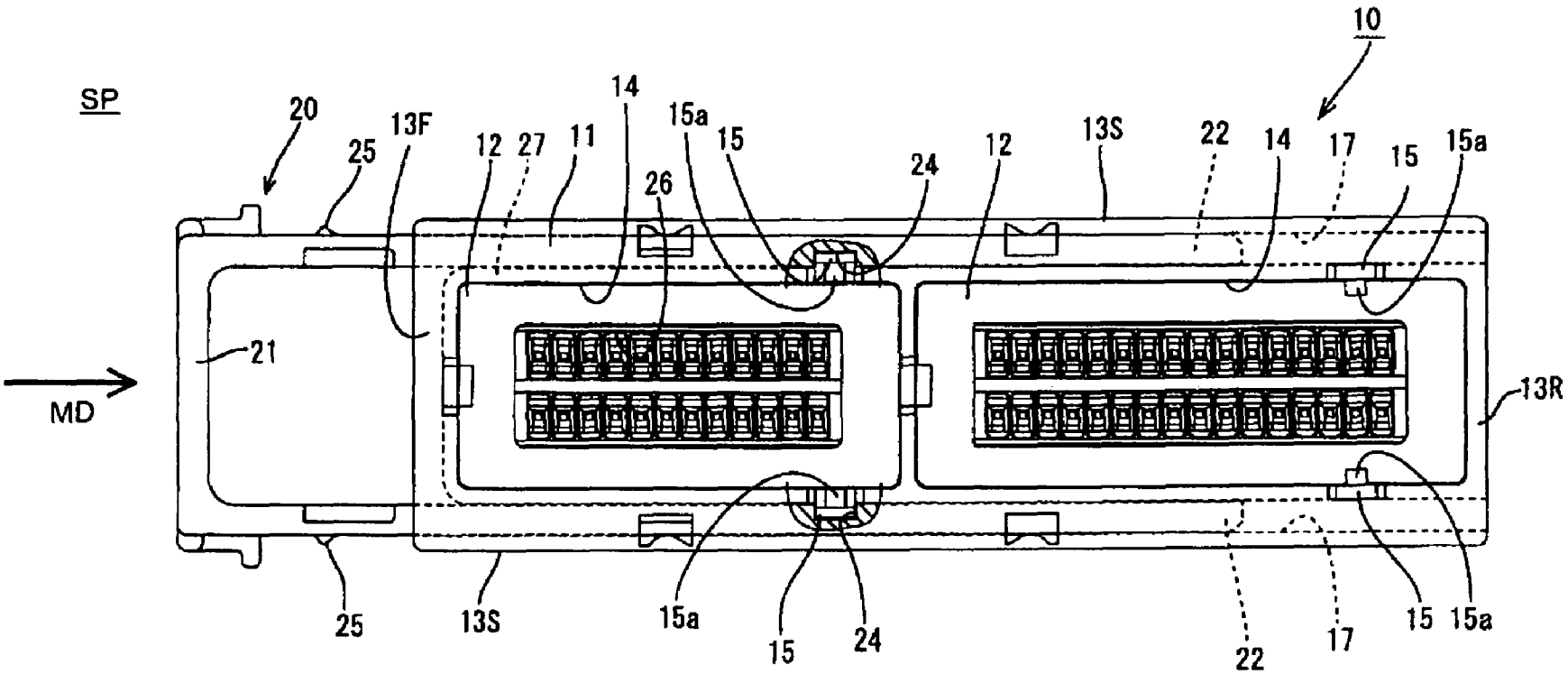
FIG. 3 is a plan view partly in section of the first connector showing a state where the slider is at the standby position and auxiliary housings are being connected.

Inner surfaces of the sliding plates 22 of the slider 20 contact the outer surfaces of the locks 15, as shown in FIG. 2, when the slider 20 is in the connecting position CP for properly connecting the two connectors 10, 30. Thus, outward deformation of the locks 15 away from the skirts 27 of the auxiliary housings 12 is prevented, and the auxiliary housings 12 are locked securely in the housing main body 11.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the locks are the preventing means in the foregoing embodiment, a separate preventing means may be provided.

Although the locks are formed in the housing main body in the foregoing embodiments, they may be formed in the auxiliary housings.

The engaging means of the slider are recesses in the foregoing embodiment. However, they may have different shapes (e.g. projections or steps) according to the present invention.

The first connector has a slider as a movable member that displays a cam action in cooperation with the second connector in the foregoing embodiment. However the movable member may be configured differently according to the invention, and may be a lever rotatably or pivotably provided on the first connector or by a movable member having a different movement path, such as a non-linear moving path.

It should be understood that the connection of the first and second connectors does not necessarily have to be performed solely by the operation of the slider, but may be merely assisted by the cam action displayed by the movable member in cooperation with the second connector according to the invention.

The slider may have one or more cam followers and the second connector may have one or more cam grooves.

Even though the lock 15 is cantilevered in the foregoing embodiment, it may be bridge-shaped with both ends supported and having the locking projection provided an intermediate position according to the invention.

What is claimed is:

1. A connector, comprising:

a housing main body;

auxiliary housings mountable in the housing main body;

resiliently deformable locks that are deformed in the process of mounting the auxiliary housings into the housing main body and that are restored resiliently to lock the auxiliary housings when the auxiliary housings are mounted in the housing main body;

a movable member movable along a movement path on the housing main body from a standby position towards a connecting position and configured for generating a cam action for connecting the connector with a mating connector as the movable member is moved; and a preventing means for blocking the movement path and preventing a movement of the movable member from the standby position towards the connecting position when the auxiliary housings are mounted improperly, while being retracted from the movement path and permitting movement of the movable member from the standby position to the connecting position when the auxiliary housings are mounted properly.

2. The connector of claim 1, wherein the preventing means comprise the locks.

3. The connector of claim 2, wherein the movable member contacts the locks to prevent deformation of the locks when the movable member is moved towards the connecting position.

4. The connector of claim 1, wherein the preventing means comprises a skirt on the auxiliary housing for contacting and resiliently deforming the lock.

5. The connector of claim 1, wherein the movable member comprises a slider movable along a moving direction arranged at an angle to an inserting direction of the auxiliary housings into the housing main body.

6. The connector of claim 1, further comprising a locking piece for temporarily locking the movable member at the standby position and the connecting position.

7. A connector assembly comprising the connector of claim 1 and a mating connector connectable therewith, wherein connection of the connectors is performed by a cam action displayed by the movable member in cooperation with the mating connector.

8. A connector, comprising:

a housing main body;

auxiliary housings mountable in the housing main body;

a movable member movable along a movement path on the housing main body from a standby position towards a connecting position and configured for generating a cam action for connecting the connector with a mating connector as the movable member is moved; and resiliently deflectable locks for locking the auxiliary housings in the housing main body after the auxiliary housings have been mounted properly in the housing main body, the locks being deflected into the movement path and preventing a movement of the movable member from the standby position to the connecting position when the auxiliary housings are mounted improperly, and the locks being retracted from the movement path and permitting movement of the movable member from the standby position to the connecting position when the auxiliary housings are mounted properly.

9. The connector of claim 8, wherein each of said auxiliary housings has a skirt for contacting and resiliently deforming the lock.

10. The connector of claim 9, wherein the movable member is a slider movable at an angle to an inserting direction of the auxiliary housings into the housing main body.

11. The connector of claim 9, wherein the slider engages the locks when the slider is in the connecting position for holding the locks in locked engagement with the auxiliary housings.

12. A connector, comprising:

a housing main body;

auxiliary housings mountable in the housing main body;

a slider movable along a moving direction on the housing main body from a standby position towards a connecting position, the moving direction being arranged at an angle to an inserting direction of the auxiliary housings into the housing main body, the movable member being configured for generating a cam action for connecting the connector with a mating connector as the slider is moved; and a preventing means for blocking the movement path and preventing a movement of the slider member from the standby position towards the connecting position when the auxiliary housings are mounted improperly, while being retracted from the movement path and permitting movement of the slider member from the standby position to the connecting position when the auxiliary housings are mounted properly, wherein the slider engages the preventing means when the auxiliary housings are mounted properly in the housing main body and when the slider is in the connecting position so that the slider holds the preventing means in locked engagement with the auxiliary housings.

* * * * *